US008842145B2

(12) United States Patent
Cridland et al.

(10) Patent No.: US 8,842,145 B2
(45) Date of Patent: Sep. 23, 2014

(54) INKLESS PRINTING APPARATUS

(75) Inventors: John Cridland, Widnes Cheshire (GB); Anthony Jarvis, Widnes Cheshire (GB); Martin Walker, Widnes Cheshire (GB); Chris Wyres, Widnes Cheshire (GB)

(73) Assignee: DataLase Limited (GB)

( * ) Notice: Subject to any disclaimer, the term of this patent is extended or adjusted under 35 U.S.C. 154(b) by 0 days.

(21) Appl. No.: 13/575,202

(22) PCT Filed: Jan. 25, 2011

(86) PCT No.: PCT/GB2011/050116

§ 371 (c)(1),
(2), (4) Date: Sep. 27, 2012

(87) PCT Pub. No.: WO2011/089447

PCT Pub. Date: Jul. 28, 2011

(65) Prior Publication Data

US 2013/0050389 A1 Feb. 28, 2013

(30) Foreign Application Priority Data

Jan. 25, 2010 (GB) ..... 1001110.4

(51) Int. Cl.

| | |
|---|---|
| ***B41J 2/47*** | (2006.01) |
| ***B41J 2/45*** | (2006.01) |
| ***B41J 2/435*** | (2006.01) |
| ***B41J 2/475*** | (2006.01) |
| *B41M 5/28* | (2006.01) |

(52) U.S. Cl.

CPC ..... *B41J 2/4753* (2013.01); *B41M 5/285* (2013.01); *B41J 2/45* (2013.01); *B41J 2/473* (2013.01)

USPC ..... 347/232; 347/238; 347/240; 347/251; 347/264

(58) Field of Classification Search

CPC ..... B41J 2/45; B41J 2/473; B41J 2/4753; B41J 2/525

USPC ..... 347/224, 225, 232, 233, 240, 251, 252, 347/262, 264, 110

See application file for complete search history.

(56) References Cited

U.S. PATENT DOCUMENTS

| | | | | |
|---|---|---|---|---|
| 3,586,437 | A * | 6/1971 | Dietz et al. | 399/76 |
| 4,782,006 | A * | 11/1988 | Nishimura et al. | 430/292 |
| 5,453,345 | A * | 9/1995 | Grasshoff et al. | 430/270.1 |
| 2001/0053164 | A1 | 12/2001 | Takeuchi | |

(Continued)

FOREIGN PATENT DOCUMENTS

| | | |
|---|---|---|
| DE | 199 55 383 | 5/2001 |
| EP | 1 884 233 | 6/2008 |

(Continued)

*Primary Examiner* — Justin Seo
*Assistant Examiner* — Kendrick Liu
(74) *Attorney, Agent, or Firm* — Salter & Michaelson

(57) ABSTRACT

A substrate marking apparatus for use in combination with a substrate comprising a multi-color change diacetylene compound is disclosed. The substrate marking apparatus comprises: at least two radiation sources operable to emit radiation of different wavelengths, optical transformation elements and a control system. The control system takes digital file information and converts this to a set of emission instructions for the radiation sources. The radiation sources are then applied to the substrate in sequence and intensity determined by the control system such that the substrate is activated to change from a colorless state to any one of a range of multiple permanent colors.

17 Claims, 1 Drawing Sheet

(56) References Cited

U.S. PATENT DOCUMENTS

| | | | | |
|---|---|---|---|---|
| 2008/0024586 | A1 | 1/2008 | Barron | |
| 2008/0318154 | A1 * | 12/2008 | Wyres | 430/270.1 |
| 2010/0014064 | A1 * | 1/2010 | Elworthy et al. | 355/67 |

FOREIGN PATENT DOCUMENTS

| | | | | |
|---|---|---|---|---|
| EP | 2 003 493 | | 12/2008 | |
| GB | 2 249 843 | | 5/1992 | |
| JP | 62-177544 | | 8/1987 | |
| JP | 63-52135 | | 3/1988 | |
| JP | 63052135 | A * | 3/1988 | G03C 5/00 |
| JP | 1-129248 | | 5/1989 | |
| JP | 2004-198689 | | 7/2004 | |
| WO | 02/12350 | | 2/2002 | |
| WO | 2006/018640 | | 2/2006 | |
| WO | 2010/001172 | | 1/2010 | |

* cited by examiner

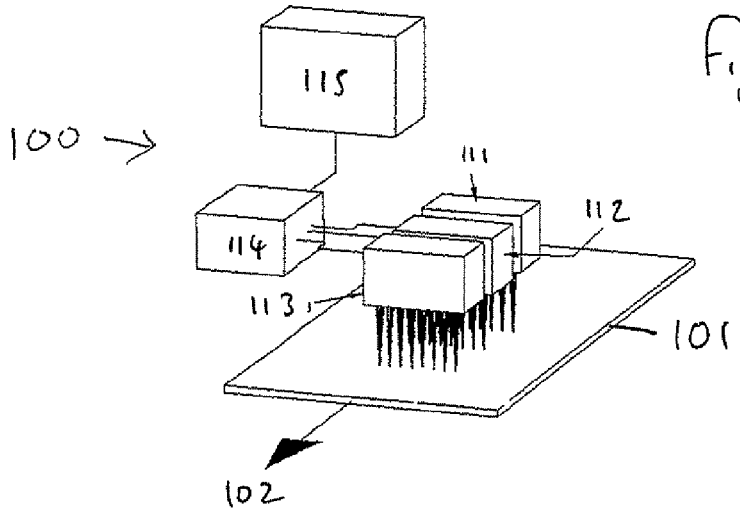
Figure 1
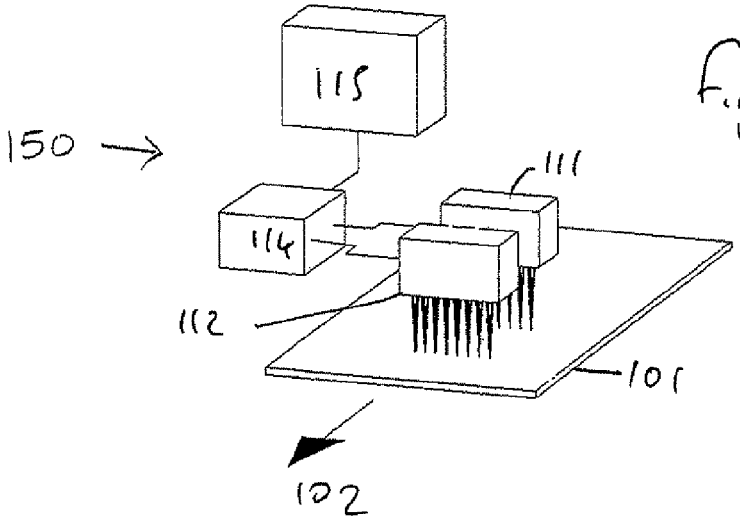
Figure 2
Figure 3
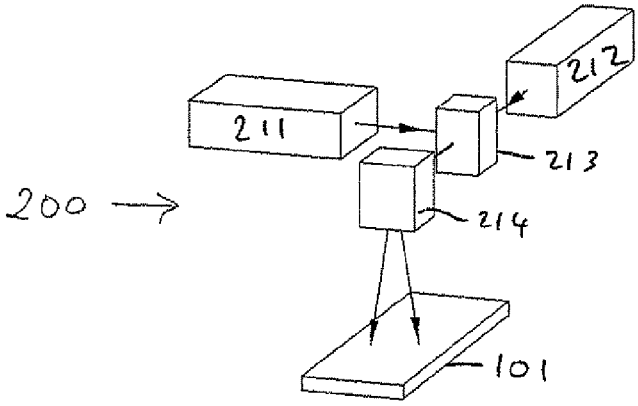

INKLESS PRINTING APPARATUS

TECHNICAL FIELD

The present invention relates to an inkless printing apparatus.

BACKGROUND OF THE INVENTION

Traditional printing methods require the formation of regions of colour on a substrate by the direct application of pigmented material to a substrate. This may be achieved using various standard methods (such as inkjet printing), thermal transfer and photographic techniques. Standard printing requires ink consumables and thermal transfer has consumable ribbons. Photographic techniques require liquid developers and fixing agents.

As an alternative to such methods, inkless printing methods were developed, using a dry process requiring no consumables at the time of fixing an image. A known inkless printing method involves providing a substrate comprising or having added to it photosensitive materials such as diacetylenes. These materials are susceptible to change colour when exposed to a suitable energy source such as a laser. In order to print a desired image, a laser beam is steered relative to the substrate so as to selectively irradiate various areas of the substrate. The subsequent colour change of the irradiated areas forms the image.

The above inkless printing methods and systems for implementing them have disadvantages. In particular, they are relatively limited in the colour change they can achieve and/or the level of control over the said colour change. This limits the effectiveness of such techniques and consequently limits commercial interest in their uptake.

It is therefore an object of the present invention to provide a solution that at least partially overcomes or alleviates the above problems.

SUMMARY OF THE INVENTION

According to the present invention there is provided a substrate marking apparatus, suitable for marking a substrate which includes material susceptible to changing colour upon irradiation, the apparatus comprising: a radiation source operable to produce radiation at two or more distinct wavelengths; and means for controlling emission of radiation from the radiation source so as to controllably irradiate selected areas of the substrate with desired quantities of radiation from the radiation source so as to mark said substrate in a desired manner.

The provision of radiation at two different wavelengths enables an additional level of control over the marking process and over the range of colours that can consequently be produced. It may also increase the efficiency of the process.

Since such an apparatus requires those areas which it is desired to mark to be irradiated by two or more distinct wavelengths, the light stability of a substrate which has been marked using an apparatus according to the present invention may be improved relative to that of a substrate which has been marked in accordance with apparatus as is already known in the art. In particular, radiation of one wavelength may be used to activate the substrate and radiation of another wavelength may be used to effect a colour change of the substrate. Since only those areas of the substrate which it is desired to mark are irradiated with the activating radiation, only these areas can subsequently be induced to change colour. Therefore, by suitable choice of these two wavelengths a significant improvement in light stability of the substrate may be achieved relative to prior art techniques and the substrate will be less susceptible to discolouring over time due to background/ambient light.

The radiation source may be a single radiation source operable to produce radiation at two distinct wavelengths. Alternatively, the radiation source may comprise two or more radiation sources. In a particular embodiment, the radiation source comprises a first radiation source operable to produce radiation of a first wavelength and a second radiation source operable to produce radiation of a second wavelength different to the first wavelength.

The means for controlling emission may comprise a microprocessor. Further control electronics may also be provided if desired. The radiation source may be operated directly by the means for controlling emission or may be operated via one or more driving amplifiers.

The means for controlling emission may be operable to convert a digital image file to a set of emission instructions for the radiation source. In particular, this may involve mapping a particular pixel in the image file to a particular spot or area of the substrate; and determining the irradiation required from the radiation source to change the colour of a spot or area of the substrate to a colour matching that of an image pixel. The irradiation required may be determined in terms of duration and/or intensity of incident radiation.

The radiation source may be operable to emit radiation in a continuous or in a pulsed manner. For embodiments wherein the radiation source comprises first and second radiation sources, both radiation sources may be operable to irradiate the same or different areas of the substrate substantially simultaneously. Alternatively, the radiation sources may be operable to irradiate the same or different areas of the substrate in a particular sequence. A sequence may comprise either single or multiple irradiations using either or both radiation sources as required or as desired.

The apparatus may comprise radiation directing means. For embodiments wherein the radiation source comprises first and second radiation sources, the radiation directing means may be operable to direct radiation from one or both radiation sources to a selected area of the substrate. The first radiation source and the second radiation source may each have a dedicated radiation directing means or the first and second radiation sources may share a common radiation directing means. The radiation directing means is preferably operable to scan emitted radiation across the surface of the substrate. To achieve this operation, the radiation direction means may comprise any of: galvanometer tilting mirrors, acousto-optic or electro-optic scanners, MEMs beam deflectors, resonant scanners or rotating polygons.

In embodiments sharing a common radiation directing means, a radiation combining element may be provided, the radiation combining element operable to combine radiation emitted from the first and second radiation sources into a single beam. The radiation combining element may be an optical component such as a prism, dichroic mirror or diffraction grating, including a holographic diffraction grating.

The first and second radiation sources may comprise single emitters or multiple emitters. In the case where a source comprises multiple individual emitters, the individual emitters may be arranged in one or more one or two dimensional arrays. In such embodiments each emitter may be individually addressable and controllable by the means for controlling emission.

Each individual emitter may be provided with a dedicated emitter radiation directing means. Each emitter radiation directing means is preferably operable to direct emitted radiation from the individual emitter onto a particular spot or area of the substrate. The directing of emitted radiation may include focusing and or turning the emitted radiation. Each emitter radiation directing means may comprise any of: a single lens; a lens pair; multiple lenses, including telecentric designs; a fibre optic light guide; or a light guide and one or more lenses in combination. In one embodiment, each dedicated emitter radiation directing means may comprise a fibre optic light guide taper, which reduces the emitted beam width. The fibre optic light guide taper may be straight. Alternatively, the fibre optic light guide taper may have a bend therein such that the input and output plane of the emitted radiation are at a non-zero angle to one another. The angle between the input and output planes may be in the range 20 degrees to 90 degrees. Use of bent fibre optic light guide taper may allow the juxtaposition of multiple arrays of emitters to form a continuous scalable wide array with increased resolution.

The apparatus may further comprise means for retaining the substrate in a desired position relative to the radiation sources or the radiation directing means. The apparatus may further be operable to controllably vary the relative position of the radiation sources or radiation directing means and the substrate. The relative positions may be varied continuously or using indexed steps. This can enable the apparatus to be used to controllably irradiate a large substrate in stages.

Preferably, the radiation source is operable to provide a first wavelength of radiation being thermal radiation. More specifically, it is preferable that the first radiation source is a device operable to deliver thermal energy to the substrate, which energy may be transferred from the source to the substrate by any means as is required and or desired. The term 'thermal radiation' will therefore be understood to include the transfer of thermal energy by any means, including conduction through contact between the source and the substrate. As described above this may be pulsed or continuously emitting and may comprise single, multiple or one or two dimensional arrays of thermal radiation emitters. The thermal radiation may have a broad spectrum or be limited to a more specific frequency range. In particular, the thermal radiation may be infrared radiation (IR) and/or near infrared radiation (NIR). Suitable thermal radiation emitters include but are not limited to: NIR/IR lasers, NIR/IR Light Emitting Diodes (LEDs), resistive or inductive heater elements.

Preferably, the radiation source is further operable to provide a second wavelength of radiation being ultraviolet (UV) radiation. As described above this may be pulsed or continuously emitting and may comprise single, multiple or one or two dimensional arrays of UV emitters. Suitable UV emitters include but are not limited to: UV lasers, UV Light Emitting Diodes (LEDs) or UV lamps (e.g. mercury or deuterium). Preferred wavelengths are in the range 100 nm to 25 microns. Particularly preferred wavelengths are in the range 200 nm to 2500 nm.

Such an embodiment wherein the radiation source is operable to provide both UV radiation and thermal radiation offers a significant improvement in efficiency over inkless printing techniques known in the art. Typically, these only utilise a single UV radiation source and, whilst it may be possible to affect the desired colour change with such an arrangement, it will often require more time and energy to do so. There is a particular advantage over such a prior art arrangement when changing the colour of the substrate from blue to red as thermal radiation sources are more efficient and offer higher radiation power at a substantially lower cost.

Furthermore, such embodiments wherein the radiation source is operable to provide both UV radiation and thermal radiation can offer a significant improvement in the stability of the colour forming layer to background/ambient light after the marking process compared to inkless printing techniques known in the art. In particular, the thermal radiation may be used to activate the areas of the substrate that it is desired to be marked and either or both of the UV and thermal radiation sources may be used to effect the colour change of those areas. In such an arrangement, only those regions that have been exposed to thermal radiation are activated and can subsequently be induced to change colour. As such, the light stability of other regions of the substrate which have not been so activated will be significantly improved, i.e. less susceptible to discolouring over time due to background/ambient light incident thereon.

The substrate may be any suitable substrate. In particular the substrate may comprise a layer of diacetylene material on a base layer. The diacetylene material layer may additionally comprise an IR or NIR absorbing material. Alternatively, the diacetylene material layer may be provided over a layer of IR or NIR absorbing material, or vice versa.

The marking apparatus may be provided with a calibration means.

According to a second aspect of the present invention there is provided a method of calibrating a substrate marking apparatus according to the first aspect of the present invention.

The calibration method may comprise the step of irradiating the substrate with a sequence of wavelengths and intensities to generate a test pattern. The test pattern may be validated by reference to a predefined calibration image. If the test pattern is not substantially the same as the calibration image, the method may further comprise the step of adjusting the apparatus and regenerating a test pattern by irradiating the substrate with an adjusted sequence of wavelengths and intensities to generate a test pattern. This adjustment may be either manual or automatic. There may be as many such adjustments as is desired and/or appropriate.

The second aspect of the present invention may incorporate any or all of the features of the first aspect of the present invention as is desired and/or appropriate.

According to a third aspect of the present invention there is provided a method of marking a substrate using an apparatus according to the first aspect of the present invention, comprising the steps of: irradiating the substrate with radiation of a first wavelength to activate it for colour change; irradiating the substrate with radiation of a second wavelength to effect a colour change of the substrate.

The first wavelength of radiation may be thermal radiation. The thermal radiation may have a broad spectrum or may comprise infrared radiation (IR) and/or near infrared radiation (NIR).

The thermal radiation source may comprise one or more NIR/IR lasers or NIR/IR Light Emitting Diodes (LEDs). Additionally or alternatively, the thermal radiation source may comprise resistive or inductive heater elements and wherein the thermal energy is provided by conduction.

The second wavelength of radiation may be ultraviolet (UV) radiation. The UV radiation source may comprise one or more of the following: UV lasers, UV Light Emitting Diodes (LEDs), UV lamps (e.g. mercury or deuterium), or UV electrical discharge sources (e.g. a corona discharge or spark).

The substrate may comprise a layer of diacetylene material on a base layer. The diacetylene material layer may comprise an IR or NIR absorbing material or may be provided over a layer of IR or NIR absorbing material.

The third aspect of the present invention may incorporate any or all of the features of the first and/or second aspects of the present invention as is desired and/or appropriate.

DESCRIPTION OF THE DRAWINGS

In order that the present invention is more clearly understood, one embodiment will now be described, by way of example only and with reference to the accompanying drawings in which:

FIG. 1 shows a first embodiment of a substrate marking apparatus according to the present invention;

FIG. 2 shows a second embodiment of a substrate marking apparatus according to the present invention; and FIG. 3 shows a third embodiment of a substrate marking apparatus according to the present invention.

DETAILED DESCRIPTION

Turning now to FIG. 1, a substrate marking apparatus 100 is shown. The apparatus 100 is suitable for marking a substrate 101 which includes material susceptible to changing colour upon irradiation, so as to form an image.

The substrate 101 comprises a base layer over which is provided a layer of diacetylene material. The diacetylene layer may either also incorporate IR/NIR absorbing material or may be provided over a layer of IR/NIR absorbing material. The skilled man will of course appreciate that substrates doped with other materials susceptible to changing colour upon irradiation, may also be used.

Examples of diacetylenes from the state of the art which are particularly suitable for use with an apparatus according to the present invention are disclosed in WO2006018640, WO2009093028 and U.S. Pat. No. 6,524,000. Particularly preferred are those that can be reversibly activated between inactive and active forms using a stimulus as radiation, or irreversibly activated using for example melt-recrystallisation from an inactive form into an active form.

The apparatus 100 comprises three print heads 111, 112, 113, each print head 111, 112, 113 being a radiation source. The print heads 111 and 113 each comprise an array of IR/NIR emitters where as the print head 112 comprises an array of UV emitters. In particular, the print heads 111 and 113 may comprise thermal contact print heads such as resistive or inductive heaters. The various individual emitters in each print head 111, 112, 113 are individually addressable and are individually controlled by a microprocessor 115 via drive amplifiers 114.

The microprocessor 115 is operable to convert a digital image file to a set of emission instructions for each print head 111, 112, 113. Typically, this involves mapping a particular pixel in the image file to a particular spot or area of the substrate; and determining the irradiation (duration and/or intensity) required from the individual emitters in each print head 111, 112, 113 to change the colour of each spot or area of the substrate to a colour matching that of each image pixel.

The individual emitters in each print head array are provided with a dedicated radiation directing means. The directing means image each individual emitter to a spot on the surface of the substrate 101, such that a specific continuous (or discontinuous) pattern of irradiated spots is formed when each emitter is emitting. The dedicated radiation directing means comprises one or more lenses and/or one or more light guides as appropriate for each emitter. Typically, each print head 111, 112, 113 is adapted such that the array of emitters in combination with the dedicated radiation directing means forms a matching pattern of irradiated spots on the substrate 101. Accordingly, pixels in an image file may be mapped to one or more irradiated spots.

The microprocessor 115 is further operable to control the movement of substrate 101 relative to the print heads 111, 112, 113. This movement may take place in a single direction as indicated by arrow 102 in FIG. 1 or in multiple directions. Typically, the movement is achieved by movement of the substrate by indexed steps in the direction as indicated by the arrow 102 such that the area of spot pattern irradiated by print head 111 is subsequently moved to a position wherein it can be correspondingly irradiated by the spot pattern of print head 112 and is then subsequently moved to a position wherein it can be correspondingly irradiated by the spot pattern of print head 113. In alternative implementations, the print heads 111, 112, 113 may be movable in addition to or in place of movement of the substrate 101. For example, in addition to the movement of the substrate by indexed steps in the direction of the arrow 102, the print heads 111, 112, 113 may move in a direction which is substantially perpendicular to the arrow 102. The width of the print heads 111, 112, 113 may or may not extend across the full width of the substrate. Preferably, if the width of the print heads 111, 112, 113 is smaller than the width of the substrate, the print heads 111, 112, 113 are operable to move in a direction which is substantially perpendicular to the arrow 102 as described above.

In use, the substrate 101 is thus sequentially exposed to radiation emitted by each print head 111, 112, 113 in turn, the irradiation of each area being determined by the radiation emitted by corresponding emitters of each print head 111, 112, 113. In the present embodiment, NIR/IR radiation emitted by print head 111 activates irradiated regions of the substrate 101 corresponding to the spot pattern of head 111. The NIR/IR radiation is absorbed by the NIR/IR absorbing material and the consequent rise in temperature activates diacetylene material from a low reactive state to a highly reactive state. Subsequently, exposure to irradiation by UV light from print head 112 effects initial polymerisation and colour change of the diacetylene material. The nature of the colour change is dependent upon the irradiation exposure. A further irradiation by NIR/IR radiation emitted by print head 113 then causes a conformational change in the diacetylene material. This can include a further colour change corresponding to the further irradiation exposure. A range of different distinct colours can thus be formed by irradiation of areas of the substrate 101 with an appropriate sequence of thermal radiation and UV radiation.

Since only the areas of the substrate which are to be marked are exposed to the NIR/IR radiation, only those areas of the diacetylene material are activated from a low reactive state to a highly reactive state. As such, the light stability of other regions of the substrate which have not been so activated will be significantly improved relative to prior art techniques which do not utilise such an activation step. In particular, there is an improvement over prior art techniques only utilising a UV radiation source. As such, the substrate will be less prone to discolouration over time due to background/ambient light.

Furthermore, since both the UV and thermal radiation sources are utilised in the colour formation steps, there is a significant improvement in the efficiency of this technique relative to prior art techniques. There is a particular advantage over prior art arrangements which only utilise a UV radiation source when changing the colour of the substrate from blue to red. This is since thermal radiation sources are more efficient and offer higher radiation power at a substantially lower cost.

As the emitters in each print head 111, 112, 113 are controllable individually, the specific irradiation sequence experienced by each area of the substrate can be controllably varied, allowing a colour image to be formed. The spatial resolution of the formed image in such cases will be limited by the size of each spot of the irradiated spot pattern of each print head 111, 112, 113.

Turning now to FIG. 2, an alternative embodiment of a substrate marking apparatus 150, is shown. In the apparatus of FIG. 2, the print heads 111, 112, the processor 115 and the drive amplifier 114 are provided as in apparatus 100 but the print head 113 is omitted. In this embodiment, the final irradiation step provided by print head 113 does not take place.

Advantageously, this embodiment uses a reduced number of steps to form an image so may be faster than the first embodiment in producing an image. Furthermore, the omission of one print head 113, may lead to a significant reduction in the production costs of the apparatus 150.

The lack of the final irradiation stage may reduce the colour range achievable using the process. Therefore, if necessary, this embodiment of the present invention may be operable to perform the step which in the previous embodiment was performed by the print head 113. In this embodiment, the radiation is provided by the print head 111. Such an embodiment enjoys the cost advantage that an apparatus with two print heads may be produced at a lower cost to an apparatus with three print heads, whilst not suffering from the more limited colour range alluded to above.

Turning now to FIG. 3 a further alternative embodiment of a substrate marking apparatus 200 is shown. In this embodiment a first radiation source 211 comprises a UV laser. A second radiation source 212 comprises an IR/NIR laser. Each source 211, 212 can be operated in a continuous or pulsed manner under the control of a microprocessor (not shown).

The radiation sources 211, 212 both provide beams of radiation to a radiation combining element 213 operable to combine the separate emissions into a single beam. The beam combining element 213 can be a prism, dichroic mirror or diffraction grating.

The single beam may be imaged to a spot on the surface of substrate 101 by a radiation directing means. The radiation directing means 214 may be further operable to scan the coincident spot across the surface of the substrate 101 under the control of a microprocessor (not shown). The radiation directing means 214 can be a galvanometer tilted mirror, an acousto-optic or electro-optic scanner, an MEMs beam deflector, a resonant scanner or a rotating polygon. The scanning of the spot across the surface of the substrate 101 may be achieved by movement of the radiation directing means 214 and/or the substrate 101. For example, for embodiments wherein the radiation directing means 214 comprises a resonant scanner and/or a rotating polygon, the substrate 101 may be moved relative to the radiation directing means 214.

As in the previous embodiments, the microprocessor is operable to convert a digital image file to a set of emission instructions for each source 211, 212 and the directing means 214. Typically, this involves mapping a particular pixel in the image file to a particular spot or area of the substrate; and determining the irradiation (duration and/or intensity) required from the individual sources 211, 212 to change the colour of each spot or area of the substrate to a colour matching that of each image pixel. By appropriate sequencing of the emissions from each source 211, 212 incident on a particular spot on the surface of the substrate 101, the colour of the spot can be controlled. Subsequently, by scanning the beam over the substrate 101 using the radiation directing means 214 an image can be built up over the full substrate 101.

The apparatus 200 can be operated in any suitable sequence. For instance, each spot of the substrate may be simultaneously exposed to radiation from both sources 211, 212 or may be sequentially exposed to pulses of radiation from each source 211, 212. In particular, in a pulsed embodiment, the sequence of exposure may be IR/NIR radiation; UV radiation; IR/NIR radiation in a similar manner to that described in the first embodiment above. In sequential exposure, the sequence may be applied on a spot by spot basis such that one spot is exposed to the full sequence before the beam is scanned to a next spot. Alternatively, the sequence may be applied on a line by line or area by area basis wherein each exposure step in the sequence is applied in turn to each spot in a line or area of spots by scanning the beam from spot to spot before the subsequent exposure steps are applied to each spot in the line or area.

Whilst the three embodiments of the apparatus 100, 150, 200 can obviously be used for inkless printing on a suitable substrate 101, each apparatus may also be applied to any other suitable task including, for example, the formation of conducting features within a suitable dielectric coating or substrate.

It is of course to be understood that the present invention is not to be limited to the details of the above embodiment which is described by way of example only.

What is claimed is:

1. A method of calibrating a substrate marking apparatus comprising the steps of:

providing a radiation source operable to produce radiation at two or more distinct wavelengths; and means for controlling emission of radiation from the radiation source so as to controllably irradiate selected areas of the substrate with desired quantities of radiation from the radiation source so as to mark said substrate in a desired manner wherein the radiation source is operable to emit radiation at a first wavelength to selectively activate irradiatable areas of the substrate for colour change and radiation at a second wavelength to effect a colour change of the previously irradiated areas of the substrate; and irradiating the substrate with a sequence of wavelengths and intensities to generate a test pattern; validating the test pattern by comparing it to a predefined calibration image; and if the test pattern is not substantially the same as the calibration image, adjusting the apparatus and generating a further test pattern by irradiating the substrate with an adjusted sequence of wavelengths and intensities to generate the further test pattern until the test pattern is substantially the same as the calibration image.

2. A method of marking a substrate as claimed in claim 1 wherein the radiation of a first wavelength activates the substrate from a first reactive state to a higher second reactive state.

3. A method of marking a substrate as claimed in claim 1 wherein the first wavelength radiation is absorbed by the substrate causing a consequent rise in temperature of the substrate from a low reactive state to a highly reactive state.

4. A method of marking a substrate as claimed in claim 1 wherein the second wavelength of radiation is ultraviolet radiation, and the first and second wavelengths of radiation are applied successively.

5. A method of marking a substrate as claimed in claim 1 including providing the first wavelength of radiation as thermal radiation.

6. A method of marking a substrate as claimed in claim 5 wherein the thermal radiation has a broad spectrum or is infrared radiation (IR) and/or near infrared radiation (NIR) wherein the thermal radiation source comprises one or more NIR IR lasers or NIR/IR Light Emitting Diodes (LEDs) and/or wherein the thermal radiation source comprises resistive or inductive heater elements and wherein the thermal energy is provided by conduction.

7. A method of marking a substrate as claimed in claim 1 including providing the second wavelength of radiation as ultraviolet (UV) radiation.

8. A method of marking a substrate as claimed in claim 7 wherein the UV radiation source comprises one or more of the following: UV lasers, UV Light Emitting Diodes (LEDs), UV lamps (e.g. mercury or deuterium), or UV electrical discharge sources (e.g. a corona discharge or spark).

9. A method of marking a substrate as claimed in claim 1 including providing the substrate that comprises a layer of diacetylene material on a base layer.

10. A method of marking a substrate as claimed in claim 9 wherein the diacetylene material layer comprises an IR or NIR absorbing material or is provided over a layer of IR or NIR absorbing material.

11. A method of marking a substrate as claimed in claim 1 including providing the radiation source as a single radiation source or wherein the radiation source comprises a first radiation source operable to produce radiation of the first wavelength and a second radiation source operable to produce radiation of the second wavelength.

12. A method of marking a substrate as claimed in claim 1 including providing the means for controlling emission that comprises a microprocessor.

13. A method of marking a substrate as claimed in claim 1 including providing the means for controlling emission that are operable to convert a digital image file to a set of emission instructions for the radiation sources.

14. A method of marking a substrate as claimed in claim 1 including providing the radiation source as operable to emit radiation in a continuous or in a pulsed manner.

15. A method of marking a substrate as claimed in claim 1 including providing a radiation directing means operable to direct radiation from the radiation source to a selected area of the substrate.

16. A method of marking a substrate as claimed in claim 1 including providing a radiation combining element, the radiation combining element being operable to combine radiation emitted from the first and second radiation sources into a single beam.

17. A method of marking a substrate as claimed in claim 1 including providing the first and second radiation sources that comprise single emitters or multiple individual emitters arranged in one or more one or two dimensional arrays.

* * * * *